United States Patent [19]

Church

[11] Patent Number: 4,891,890

[45] Date of Patent: Jan. 9, 1990

[54] METHOD AND APPARATUS FOR TREATMENT OF FABRICS IN LAUNDRY DRYERS

[75] Inventor: John A. Church, Princeton Junction, N.J.

[73] Assignee: Colgate-Palmolive Co., Piscataway, N.J.

[21] Appl. No.: 118,680

[22] Filed: Nov. 9, 1987

[51] Int. Cl.[4] ..... F26B 7/00

[52] U.S. Cl. ..... 34/12; 34/45; 34/60

[58] Field of Search ..... 68/20, 205 R; 239/289, 239/332, 70, 282; 8/158; 34/53, 12, 60

[56] References Cited

U.S. PATENT DOCUMENTS 2,846,776 8/1958 Clark ..... 34/60

4,618,099 10/1986 Nagao et al. ..... 239/332

*Primary Examiner*—Henry A. Bennet

*Attorney, Agent, or Firm*—Bernard Lieberman; Murray M. Grill

[57] ABSTRACT

A method of applying various treating agents to fabrics in a clothes dryer and apparatus for carrying out the method having a reservoir for the agent(s), a pump and a power supply, all of which, in the preferred embodiment, are removably attached to the inside of the dryer door and are self-powered. This Abstract shall not be construed to limit the scope of this invention or of the claims.

3 Claims, 2 Drawing Sheets

METHOD AND APPARATUS FOR TREATMENT OF FABRICS IN LAUNDRY DRYERS

FIELD OF THE INVENTION

Devices for injecting treating agents into clothes dryers.

BACKGROUND

Automatic hot air clothes dryers are highly convenient and widely used devices in the United States and many other countries.

Such dryers do have a major drawback, namely, that they dry certain types of clothing in a wrinkled fashion. This is particularly undesirable in connection with shirts, blouses and other types of clothing, particularly the so-called "wash and wear" type. The latter, as is known, are intended to be ready for wearing upon removal from the dryer. However, in many cases such clothes are wrinkled at the end of the drying cycle, thereby requiring ironing.

There are other items dried in clothes dryers, such as sheets, which are also wrinkled in the drying process and thus must be ironed.

Thus, it is desirable to provide a method and apparatus for applying anti-wrinkling agents on clothes during the operation of the dryer. In addition, it is often desirable to apply other agents, such as anti-bacterial agents, fabric softeners, bleaches, anti-deodorants, mildew preventatives, mothproofing agents and the like during the drying process. These agents, including anti-wrinkling agents, are collectively referred to as "agents" or conditioners" for ease of reference.

In the past, a number of devices for dispensing the above agents have been designed.

One such device is that shown in the U.S. Pat. No. 3,267,701 wherein the dispensing device 10 is attached to the inside of the dryer door. However, while the sprayer is detachable, its construction is quite complicated—and, therefore, expensive, requires modification of the dryer and is powered by electrical leads coming from the power supply circuit of the dryer itself.

The '701 patent thus illustrates a critical drawback in the prior art: a high percentage of dryers now in homes in the United States and elsewhere do not contain agent applicators ("sprayers") and therefore cannot be readily modified to be equipped with sprayer devices such as that of the '701 patent. In turn, this presents a problem: many new and effective agents have recently been developed for use in dryers, but, as indicated, most existing dryers have no means for using them.

Hence, there is a great need for a sprayer device which can be easily attached to the inside of dryers now in use and which does not require any modification of electric wiring, etc. As will be seen, the present invention provides such a device which is self-contained, i.e., it has its own power source and is easily attachable to existing dryers.

As indicated, a number of other patents have been granted for sprayer devices, but all are designed to be built in as part of the original dryer and use the power source thereof. In addition, most of these also require the original dryers of which they are an integral part to include pumps, pipes and other electrical and mechanical modifications.

Examples of the latter—all of which are U.S. Patents—are U.S. Pat. No. 4,236,320 which discloses an external pump 8 for forcing agents in an internal container 6 through a nozzle 11 via a series of pipes. The power supply for pump 8 is not disclosed, but appears to be from the main power supply of the dryer itself. U.S. Pat. No. 4,053,992 appears to be a non-powered container for fabric softeners and the like. U.S. Pat. No. 2,846,776 shows a glass jar 21 for agents and a spray head 22 and an air pump 26 for the sprayer built into the dryer and powered by the dryer. U.S. Pat. No. 3,103,450 is another complicated device which is constructed as part of the original machine, which is a coin-operated dry cleaning machine, and requires access via a front door and an operator accessible rear door. U.S. Pat. No. 3,172,604 discloses an externally mounted sprayer, the power supply for which is not apparent. U.S. Pat. No. 3,435,537 discloses a device for dispensing solid volatile fabric treating agents which has no moving parts and wherein the rate of treatment is a function of heat and volatibility of the active ingredient. U.S. Pat. No. 3,364,585 is well-representative of a dryer with a sprayer mechanism of considerable complexity built in the machine during original manufacture thereof. Patents of even less significance are U.S. Pat. Nos. 4,609,127; 3,245,737 and 4,569,462.

The foregoing review of the prior work in this field well illustrates the need for a portable (i.e., detachable) sprayer unit which has a self-contained power source and which can be easily attached to the inside of existing—as well as future—clothes dryers in order to provide means for applying agents. This is a primary purposes of the present invention.

Another important purpose of this invention is to provide such a portable device which is operable to deliver agents to the clothes in the dryer at selected times during the operation of the dryer. This is important because the timing of the application of certain agents is significant to their efficacy.

These and other objects and advantages of the present invention will be apparent from the foregoing, the following description of the preferred embodiment, from the claims and from the drawings.

DETAILED DESCRIPTION OF THE PREFERRED EMBODIMENT

Figure 1:
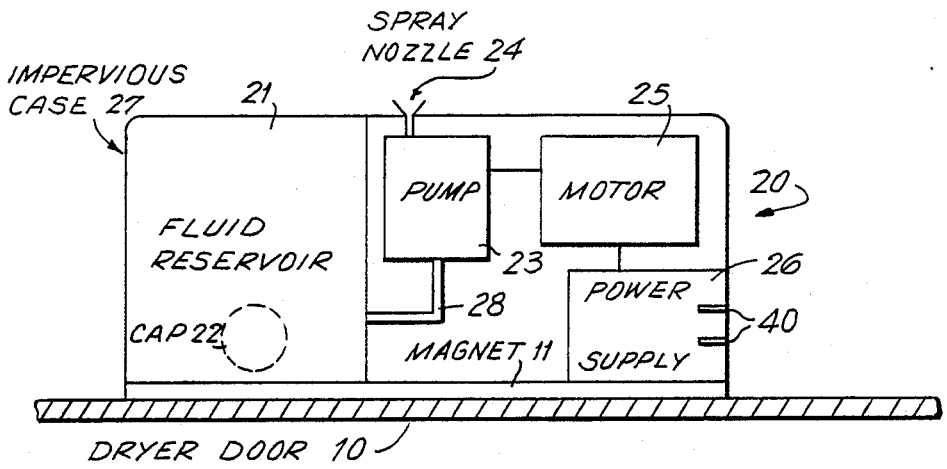
FIG. 1 is a schematic top plan view of one preferred embodiment of this invention applied to the inside of a dryer door.

Turning to FIG. 1, there is shown a plan view of the sprayer device of this invention, generally designated as 20, attached to the inside of a door 10 of a conventional horizontal, tumble dryer of either the electrical or gas type by means of a magnet 11. The magnet 11 is the back surface of the housing 27 for the sprayer 20 and it will be understood that the unit 20 can be removed at will and re-attached at will.

Within housing 27, there is a reservoir 21 for the agent(s) which are normally fluids. The agents are introduced into reservoir 21 through a cap 22 by the user. The agents flow from reservoir 21 through a pipe 28 to a pump 23 which is driven by a motor 25. Motor 25 is energized by a power supply 26 which preferably is self-contained. This is preferable because the use of another source of power would require connection with the wiring of the dryer—a complicated and expensive task.

Thus, when the timing mechanism turns on the power supply, the motor 25 is turned on which activates pump 23 which draws agents from reservoir 21 through tube 28 and the agents are pumped out of spray head 24 and onto the clothes and other items being dried in the dryer.

Figure 2:
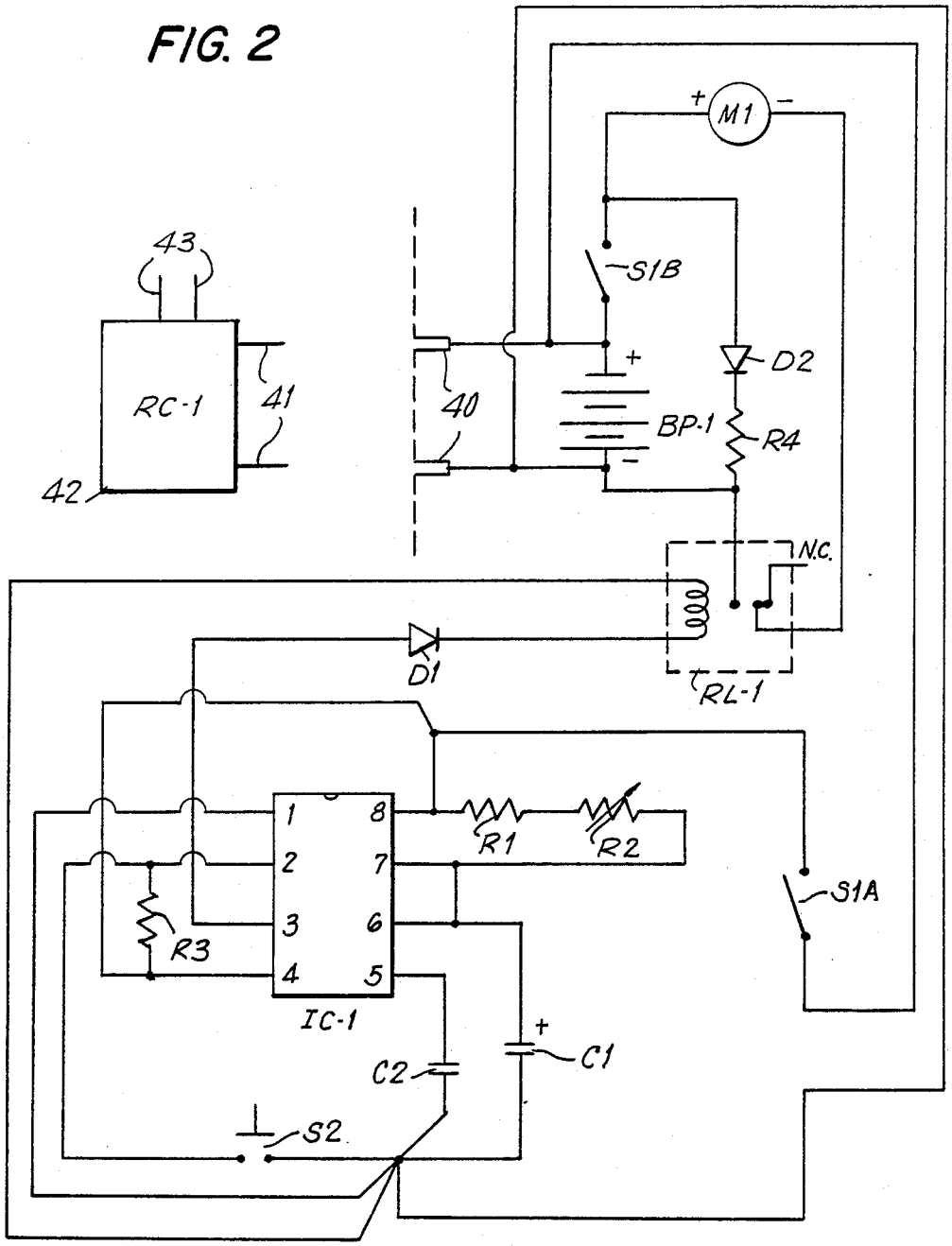
FIG. 2 is a schematic wiring diagram for the device of FIG. 1.

FIG. 2 illustrates the wiring diagram for the unit 20 which, in this case, is battery-powered so as to eliminate the need for external power sources and related wiring.

BP-1 is a power source and may be 10 1.2 volt AA rechargeable batteries, preferably Nickel Cadmium batteries. The batteries BP-1 form a battery pack and are connected to a female receptacle 40. The receptacle 40 is adapted to receive the male prongs 41 of a recharging device 42 which, in turn, has prongs 43 which fit into the receptacle of the usual household 115 volt wall outlet (not shown). It will be understood that the power pack BP-1 can thus be easily recharged by removing the device 20 from the dryer and recharged by using the recharger 42 in the home.

M1 in FIG. 2 is a schematic combination of the pump 23 and motor 25 shown in FIG. 1. Similarly, the power supply labeled 26 in FIG. 1 is the battery pack BP-1 in FIG. 2.

RL-1 is a relay (3 Amp) which may be Radio Shack 275-247 wired normally open.

IC-1 is a Radio Shack (RS) 276-1723 bipolar type 555 timer circuit and the socket for the IC-1 is a RS 276-1995.

S1A and S1B are a RS 275-403 DPDT slide switch.

S2 is a momentary contact push button switch, RS 275-1547.

C1 is a 100 uF capacitor, 35 Volt, RS 272-1016.

C2 is a 0.01 uF capacitor, 50 volt, RS 292-1065.

D1 is Type 1N914 Diode, RS 276-1620.

D2 is a LED, green, RS 276-037.

R1 is a 1 megohm resistor, .25 watt, RS 271-1356.

R2 is a 1 megohm potentiometer, RS 271-1335.

R4 is a 470 ohm resistor, .25 watt, RS 271-1317.

With the foregoing circuitry, it is possible to use the present invention to pump agents through spray nozzle 24 into the interior of the dryer during its operation at selected times. This is made possible because the device 20 is a completely self-contained, self-powered unit.

In a typical procedure, 100-120 ml of liquid agent(s) are poured into the reservoir 21. The timing control circuit shown in FIG. 2 is adjusted via potentiometer R2 to control the duration of the spray cycle—typically, about 3.5 minutes are sufficient for agents such as those used for anti-wrinkling purposes. The timer control circuit is turned on by switch S2 shown in FIG. 2 after switch S1A/S1B is turned on. If desired, a different timer mechanism may be employed which automatically starts and controls the duration of the spray action and which can be preset by the user in the manner of conventional timers used to control dryers, washers and like equipment.

In home use, the dryer is loaded with clothing and other items from the washing machine, preferably in a damp condition. The reservoir 21 is filled with agent(s) via cap 22 and the device 20 is attached to the inside of the dryer front door. The main slide switch S1A/S1B is turned on and the green LED glows indicating the ready status.

The dryer door is then closed most of the way and the button switch S2 is pushed to start the spray cycle. The door 10 is then closed and the dryer is turned on. After about 3.5 minutes, the sprayer 20, under control of the circuit, is turned off. The batteries power the unit for at least three spray cycles before recharging is needed.

In summary, distinct from the prior work in this field, it can be observed that the present invention provides a unique method of spraying clothes in a dryer and a portable, self-contained and self-powered device for accomplishing this objective without the need for an elaborate and expensive retrofit of existing dryers, thereby making it possible to utilize newly developed anti-wrinkling agents and other agents.

What is claimed is:

1. A universal self-contained spray apparatus powered by a battery for use in a clothes dryer comprising:

(a) a housing including attachment means for removable attachment of the spray apparatus to the dryer;

(b) a fluid reservoir within the housing, said reservoir having an opening for the introduction of a fluid fabric treating agent;

(c) a spary nozzle for injecting a spray of the agent into the dryer onto items being dried during operation of the dryer;

(d) a pump for drawing the agent from the reservoir and forcing it through the nozzle;

(e) a motor for driving the pump;

(f) a power supply housing for the battery; and (g) timing circuit means for controlling the motor including means for setting the time when the motor is turned on and off.

2. The invention of claim 1 wherein the apparatus also includes means for receiving a battery recharger.

3. A method of spraying clothes with one or more agents in a clothes dryer comprising the steps of:

(a) attaching a universal self-contained battery operated spraying apparatus to the interior of the dryer, said apparatus including a supply of the agent, means for spraying the agent into the dryer, and timing circuit means for actuating the spraying means;

(b) setting the timing means to select when the agent will be sprayed and the duration of such spraying; and (c) operating the dryer.

* * * * *